US008845956B2

(12) United States Patent
Gentsch et al.

(10) Patent No.: US 8,845,956 B2
(45) Date of Patent: Sep. 30, 2014

(54) METHOD FOR PRODUCTION OF A CONTACT PIECE FOR A SWITCHGEAR ASSEMBLY, AS WELL AS A CONTACT PIECE ITSELF

(75) Inventors: Dietmar Gentsch, Ratingen (DE); Guenter Pilsinger, Duesseldorf (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 12/627,613

(22) Filed: Nov. 30, 2009

(65) Prior Publication Data

US 2010/0129254 A1 May 27, 2010

Related U.S. Application Data

(63) Continuation of application No. PCT/EP2008/004221, filed on May 28, 2008.

(30) Foreign Application Priority Data

Jun. 1, 2007 (EP) ..... 07010889

(51) Int. Cl.

| | |
|---|---|
| ***B22F 3/14*** | (2006.01) |
| ***B22F 3/24*** | (2006.01) |
| ***H01H 11/04*** | (2006.01) |
| ***B22F 3/12*** | (2006.01) |
| *B22F 3/16* | (2006.01) |

(52) U.S. Cl.

CPC ..... *H01H 11/048* (2013.01); *B22F 2003/166* (2013.01); *B22F 3/1283* (2013.01); *B22F 2998/00* (2013.01); *B22F 2999/00* (2013.01)

USPC ..... 419/8; 419/5; 419/28; 419/48; 75/228; 75/246

(58) Field of Classification Search

USPC ..... 419/8, 28, 48; 75/228, 246

See application file for complete search history.

(56) References Cited

U.S. PATENT DOCUMENTS

| | | | | |
|---|---|---|---|---|
| 4,325,734 | A * | 4/1982 | Burrage et al. | 419/60 |
| 4,537,745 | A * | 8/1985 | Hassler et al. | 75/10.13 |
| 4,836,978 | A * | 6/1989 | Watanabe et al. | 419/10 |

(Continued)

FOREIGN PATENT DOCUMENTS

| | | | |
|---|---|---|---|
| DE | 38 40 192 | A1 | 6/1989 |
| DE | 197 17 024 | A1 | 10/1998 |

(Continued)

OTHER PUBLICATIONS

Sanderow ("Powder Metallurgy Methods and Design," ASM Handbook, vol. 7 (1998), p. 9-15.*

(Continued)

*Primary Examiner* — Devang R Patel

(74) *Attorney, Agent, or Firm* — Buchanan Ingersoll & Rooney PC

(57) ABSTRACT

The disclosure relates to a method for production of a component, such as a contact piece, for a switchgear assembly. To introduce a slot and apply a contact outer contour directly during the powder-metallurgical production process of the contact material, contouring in the form of a slot or slots is introduced into the powder-metal material, which is located in a mold, essentially in a direction parallel to a normal to a surface of the component, to form the component with a slot.

12 Claims, 3 Drawing Sheets

(56) References Cited

U.S. PATENT DOCUMENTS

| | | | | |
|---|---|---|---|---|
| 5,330,702 | A * | 7/1994 | Kippenberg et al. | 419/28 |
| 6,010,659 | A * | 1/2000 | Gentsch et al. | 419/27 |
| 2002/0192102 | A1 * | 12/2002 | Sagawa et al. | 419/8 |
| 2009/0145883 | A1 | 6/2009 | Gentsch | |

FOREIGN PATENT DOCUMENTS

| | | | |
|---|---|---|---|
| EP | 1111631 | A2 | 6/2001 |
| JP | 58-37102 | A | 3/1983 |
| JP | 01149903 | A * | 6/1989 |
| WO | WO 90/15424 | A | 12/1990 |
| WO | WO 2006/111175 | A1 | 10/2006 |

OTHER PUBLICATIONS

International Search Report (PCT/ISA/210) for PCT/EP2005/004063 mailed Dec. 23, 2005.

European Search Report for EP 07010889.9 mailed Nov. 20, 2007.

* cited by examiner

METHOD FOR PRODUCTION OF A CONTACT PIECE FOR A SWITCHGEAR ASSEMBLY, AS WELL AS A CONTACT PIECE ITSELF

RELATED APPLICATIONS

This application claims priority as a continuation application under 35 U.S.C. §120 to PCT/EP2008/004221, which was filed as an International Application on May 28, 2008 designating the U.S., and which claims priority to European Application 07010889.9 filed in Europe on Jun. 1, 2007. The entire contents of these applications are hereby incorporated by reference in their entireties.

FIELD

The disclosure relates to a method for production of a contact piece for a switchgear assembly, and to a contact piece itself.

BACKGROUND INFORMATION

Contact pieces are used with, for example, low-voltage, medium-voltage and high-voltage switching devices, as well as generator switching devices, which are equipped with vacuum interrupter chambers. The vacuum interrupter chambers are frequently equipped with a so-called radial magnetic field (RMF) contact system. The radial magnetic field is generated by sickle-shaped coil segments. The sickle-shaped elements are produced by slots which are introduced into a contact piece plate. It is also possible to use a slotted contact pot which generates the radial magnetic field on an annular surface.

Any desired slots can be introduced into the contact piece plate. For example, it is also known to use slots in a contact plate when using AMF contact systems. Furthermore, components are produced for widely different applications by powder metallurgy such as when pressing abrasive powders without the use of lubricants.

RMF contact systems can possess low current-path resistance for the overall arrangement using a contact pressure force.

RMF contact pieces in the shape of cylindrical disks are known, whose outer edges are rounded in order to improve the dielectric characteristics. Metal-cutting methods are used to apply the outer contour and to introduce the slots. The external geometry is accordingly applied by a turning operation, and the slots are introduced into the contact piece by sawing or milling. In the case of contact plates which are comparatively thin, it is also possible to use stamping methods. Once the slots have been introduced, the slot edges can be rounded, reworked or deburred manually or by machine in order to increase the dielectric strength of the mutually opposite contact pieces.

Both an external geometry and a slot geometry can be incorporated in a blank directly during production of a contact piece. Slots aligned at right angles to a surface can be introduced as well as slots which are intended to be oriented at an angle to the surface. Furthermore, the slots can extend as far as the external circumference of a disk, and end within it.

Contact pieces are known which are composed of two layers (e.g., CuCr powder layer and Cu powder layer). An erosion-resistant layer may be composed of the standard contact material CuCr 25, which is predominantly used for medium voltages, and a second layer can be composed of pure copper for high conductivity in this layer. Further layers are likewise feasible.

Use of multilayer (e.g., three or more layer) contact blanks and contact pieces is also known.

Furthermore, known methods can be used in engineering for a multiplicity of applications for pressing of powders, such as in the case of abrasive powders. This opens up a wide field for the powder-metallurgical P/M production of components without the use of lubricants, which can be added to the powders to be pressed. These lubricants can be added to the powder materials with a proportion by weight of about 1% in order to considerably lengthen the tool life. However, the lubricants are then forced out of the finally pressed component (the blank).

For example, DE 3840192 C2 discloses a switching contact arrangement for electrical vacuum switches, whose slotted contact pieces are formed from a plurality of disks placed one on top of the other. In this case, the individual disks are slotted by stamping.

U.S. Pat. No. 6,010,659 and EP 1111631 disclose a method for production of a multilayer contact (MLC) having a plurality of layers. An ability to produce a contact from two layers CuCr and copper, for example in a ceramic crucible using the sintering-melting method is also disclosed.

DE 19717024 A1 discloses production of a contact piece provided with slots for a vacuum interrupter chamber, and a shaping tool for carrying out the method. In this case, the slot edges are shaped and are rounded by a pressing process, using a pressing tool.

The slots can also be introduced using metal-cutting methods.

The generation of a contact piece geometry by a cutting technique is, of course, associated with corresponding costs. Manual deburring or deburring by a tool involves an additional process for deburring or rounding of the slot edges.

SUMMARY

A method for powder-metallurgical production of a component of a switching device is disclosed, comprising: placing powder-metal material into a mold; and contouring a slot into powder-metal material which is located in the mold, essentially in a direction parallel to a normal to a surface of the component, to form the component with the slot.

A component is also disclosed which is produced using a method comprising: placing power-metal material into a mold; and contouring a slot into the powder-metal material which is located in the mold, essentially in a direction parallel to a normal to a surface of the component, to form the component with the slot.

BRIEF DESCRIPTION OF THE DRAWINGS

The disclosure will be described in more detail in the following text, and illustrated in the drawings, in which.

DETAILED DESCRIPTION

Figure 1:
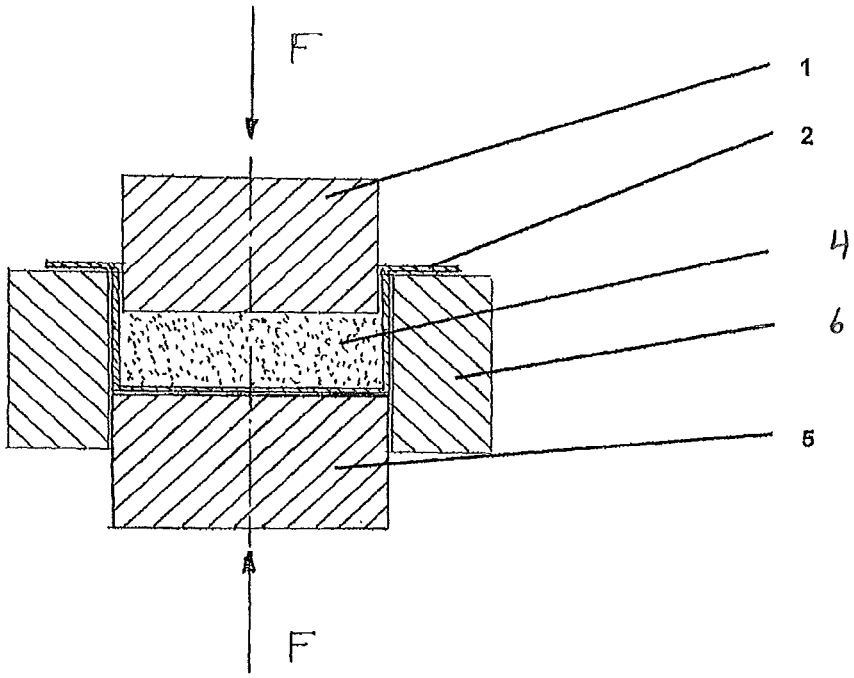
FIG. 1: shows an exemplary pressing tool and a plastic film inserted in it.

A method is disclosed for introducing a slot and/or of producing a contact directly during a powder-metallurgical production process of the contact material.

According to exemplary embodiments, contouring in the form of a slot or slots can be introduced into a component and/or into a contact piece and/or into a powder-metal material, which is located in a mold, essentially in a direction parallel to a normal to a surface of the component or contact piece.

In other words, slots can be pressed into the powder mixture from above by means of a tool. This can be considerably simpler than any other way of introducing slots.

Contouring in the form of a slot or slots can be introduced into the powder mixture via a film which is arranged between the tool and the powder metal.

In this case, the film may be in two exemplary alternative forms, either a thin plastic film or a thin metal film.

In exemplary embodiments, the film has a thickness of 0.001 mm to 2 mm, or lesser or greater.

In an exemplary method, the film is fitted into the mold of the powder metal filling by direct extrusion in a separate method step before the slots are pressed in.

The powder mixture may, for example, be a mixture of copper and chromium.

The component, when for example formed as a contact piece, can be in the form of a multilayer contact piece.

The proportion of chromium may be between 0 and 100 per cent by weight.

Powder can be used which has already been alloyed in the production process.

In this case, particle sizes of 0 to 150 micrometers (or lesser or greater) can be advantageous for the granulate, that is to say the powder.

In order to achieve final dimensions without any metal-cutting step, after the pressing process and/or after the heat-treatment of the blank, a final calibration pressing process can be carried out accurately for the final dimensions.

For use in vacuum interrupter chambers, the component or contact piece can be chemically heat treated in a hydrogen atmosphere, and/or to be degassed by heat treatment in a vacuum.

These measures can also make it possible to partially or entirely avoid the costs for generation of the contact piece geometry. A cost saving can be achieved by reducing the amount of powder material used, by avoiding the material volume of the slots, as well as the excess dimensions which may normally be used (of the finished component for machining). If no lubricants are added to the powder material to be pressed, then, for example, in the case of abrasive powders or else powder mixtures, there is a risk of the pressing tool life being reduced. When using this method, there is no need to add lubricants to the powder material.

A ready-for-installation contact piece can be produced by choosing a powder-metallurgical production process in the following exemplary manner:

1. Pressing Related to the Production of CuCr Contact Pieces:

After mixing the powders copper and chromium, the powder mixture is inserted in a mold which is provided completely or else only partially with a plastic or metal film. In addition to the upper die and lower die that are used, these also contain the web, for example of a die side. It may be desirable for the webs likewise to be arranged such that they can move, for example in the die. The two dies can be designed such that the external geometry is applied at the same time as the pressing of the powder mixture together with the slots on to the resultant blank. In this case, the powder or powder mixture can be located in a thin-walled film (bag), such as in that surface area where the high pressures occur.

Once the blank has been removed from the mold, this results in a blank whose dimensions are close to the dimensions of the drawing, that is to say the final dimensions, but which are provided with the necessary sintering supplement (shrinkage supplement) before the sintering of the material, and the film that is present can be removed from the tool and from the pressed item before the following cycle is started. The design of the tool and the number of trials can be shortened by the use of appropriate calculation software for sintering allowing prediction of the majority of the possible distortion, or of the distortion which may occur, for example during the subsequent sintering process, in advance (for example density differences which remain in the blank during pressing, sintering activity . . . ).

2. Sintering:

As normal, the sintering of the blank contact pieces can be carried out in a vacuum or in hydrogen, without any lubricant having been used for the production of a blank. However, for the production of a ready-to-use contact piece, a reducing atmosphere can/should be present at least temporarily (heat treatment). A vacuum heat treatment may possibly subsequently be advantageous after this reducing process step, in order to reduce the hydrogen gas content in the material.

3. Calibration Pressing:

If distortion of the ready-to-use contact piece nevertheless occurs during the sintering process, or the specified final dimensions cannot be achieved, then the contact piece can be calibrated in a further pressing method and can thus be brought to the final dimensions, and/or any external radii, inclines, steps etc. that are still desired can be applied.

FIG. 1 shows a pressing tool with a plastic film (2) inserted in it. The tool is equipped with a molding film over the entire surface area or only over part of the area. The powder 4 can, for example, be included in a film bag (2) (bag closed on one side in some areas or else effective only in the edge area). The upper die (1) presses against the lower die (5), with the powder (4) to be pressed located between them. The radially occurring forces are absorbed by the mold (6).

Figure 2:
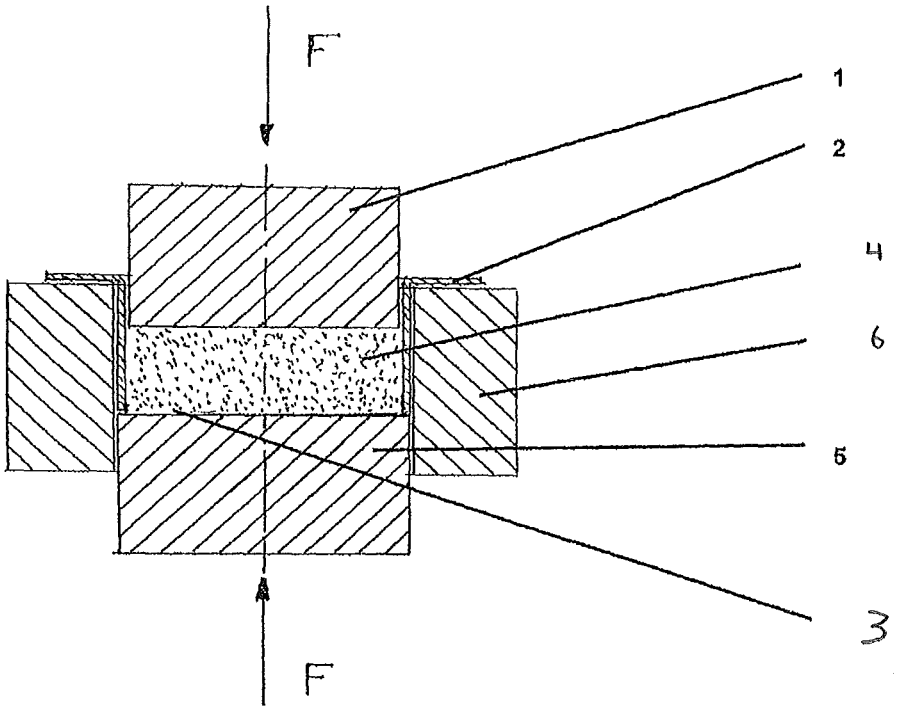
FIG. 2: shows an exemplary plastic film with an open base.

FIG. 2 shows a pressing tool with a plastic film (2) inserted in it, which acts only in part of the area, and the base (3) is not present. The upper die (1) presses against the lower die (5) with the powder (4) to be pressed being located between them. The radially occurring forces are absorbed by the mold (6).

Figure 3:
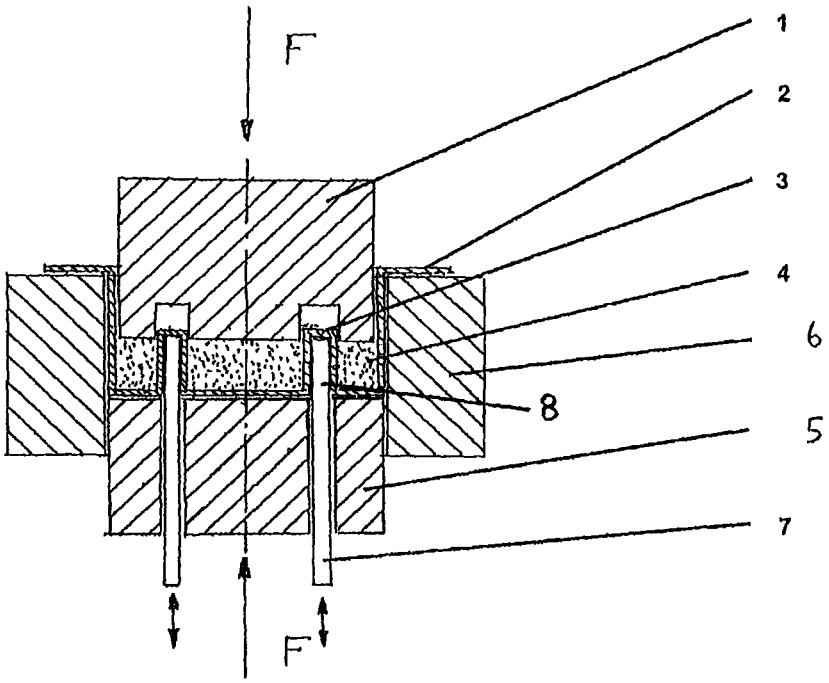
FIG. 3: shows exemplary inserts in the pressing mold.

FIG. 3 shows a pressing tool with a plastic film (2) inserted in it, whose shape is more complex in some areas. The tool is equipped with a molding film over the entire surface area, or over only part of the area. The powder can, for example, be included in a film bag (2) (bag closed on one side in some areas or else effective only in the edge area). The upper die (1) presses against the lower die (5) with the powder (3) to be pressed being located between them. More complex pressing shapes or slots 8 can be generated in this case (7) by means of appropriate inserts, and the film may be present (3) in part of the area, or else can be produced without a base. The radially occurring forces are absorbed by the mold (6).

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Upper die
2 Film
3 Subarea, open base
4 Metallurgial powder
5 Lower die
6 Mold
7 Inserts
8 The slots

What is claimed is:

1. A method for powder-metallurgical production of a component of a switching device, comprising:

placing powder-metal material into a mold;

arranging a film between a lower die of a pressing tool and the mold on one side and the powder-metal material on another side;

providing a plurality of inserts through openings in the lower die; and contouring slots into a surface of the powder-metal material by applying the plurality of inserts to the film and to the powder-metal material where the slots are to be formed, using a pressing process in a direction normal to the film and to the surface of the powder-metal material to form the slots in the component.

2. The method as claimed in claim 1, wherein the film is a thin plastic film.

3. The method as claimed in claim 1, wherein the film is a thin metal film.

4. The method as claimed in claim 1, wherein the film has a thickness of 0.001 mm to 2 mm.

5. The method as claimed in claim 1, comprising:

fitting the film into the mold on a powder metal filling by direct extrusion before the slot is pressed in.

6. The method as claimed in claim 1, wherein the powder-metal material comprises a mixture of copper and chromium.

7. The method as claimed in claim 1, wherein the component is a contact piece formed as a multilayer contact piece.

8. The method as claimed in claim 1, wherein the powder-metal material is powder that has been alloyed.

9. The method as claimed in claim 1, wherein the powder-metal material comprises a granulate with a particle size greater than 0 and less than or equal to 150 micrometers.

10. The method as claimed in claim 5, comprising:

after pressing and/or after a heat-treatment of a blank used to form the component, a calibration pressing process is carried out for a final dimension.

11. The method as claimed in claim 1, comprising:

at least one of chemically heat treating the component in a hydrogen atmosphere, and degassing by heat treatment in a vacuum.

12. The method as claimed in claim 1, wherein the component is a contact piece for a low-voltage, medium-voltage, high-voltage or generator switching device.

* * * * *